United States Patent [19]

Johnson et al.

[11] Patent Number: 4,467,151

[45] Date of Patent: Aug. 21, 1984

[54] PLANAR TOUCH PANEL

[75] Inventors: Robert J. Johnson, Inver Grove Hgts.; Charles N. Miller, Apple Valley; G. Patrick Bonnie, Minneapolis, all of Minn.

[73] Assignee: Control Data Corporation, Minneapolis, Minn.

[21] Appl. No.: 449,048

[22] Filed: Dec. 13, 1982

[51] Int. Cl.[3] ..... H01H 13/70

[52] U.S. Cl. ..... 200/5 A; 200/86 R; 200/159 B

[58] Field of Search ..... 200/5 A, 86 R, 159 B

[56] References Cited

U.S. PATENT DOCUMENTS

| | | | |
|---|---|---|---|
| 3,617,666 | 11/1971 | Braue | 200/86 R |
| 3,668,337 | 6/1972 | Sinclair | 200/86 R X |
| 4,085,302 | 4/1978 | Zenk et al. | 200/5 A |

*Primary Examiner*—J. R. Scott

*Attorney, Agent, or Firm*—F. W. Niebuhr; J. A. Genovese

[57] ABSTRACT

An electrical switch comprising a touch panel includes a flexible membrane having a series of parallel, electrically conductive strips formed thereon; and an opposed substrate layer having conductive strips thereon parallel and orthogonal to the membrane strips. A series of filament spacers, running parallel to the substrate layer strips, are positioned between the membrane and substrate layer to maintain the membrane strips and substrate strips in spaced-apart relation to each other. The filament spacers are secured to an associated boundary or frame. Finger or instrument pressure selectively applied to the membrane and directed toward the substrate, can establish contact between a chosen membrane strip and substrate strip to close the switch. The elastic deformation of the filament spacers enhances contact closure and contact life expectancy. The presence of insulative dust, which interferes with the current flow between the contacts, is eliminated.

10 Claims, 4 Drawing Figures

PLANAR TOUCH PANEL

BACKGROUND OF THE INVENTION

This invention relates to flexible membrane switches including a flexible, electrically insulative membrane with a series of parallel elongate conductive strips formed on one surface thereof, and an insulative substrate with parallel and elongate conductive strips formed on one of its surfaces. The membrane and substrate are mounted in spaced-apart relation with the strips of each facing the other and oriented perpendicular to the strips of the other. The membrane permits the closing of a selected circuit by application of finger or instrument pressure to a selected location on the membrane corresponding to the intersection of the selected membrane strip and substrate strip. When the pressure is released, the membrane returns to its normal, unstressed configuration and the circuit is open once again.

Flexible membrane switches have various applications including controls for household appliances, vending machines and telephones. One adaptation, particularly well suited for use in computer-based education and training, involves the use of substantially transparent materials for the substrate, membrane and the conductive strips. Viewing images on a CRT (cathode ray tube) screen through such a switch, a student is able to close selected circuits in response to instructions, test questions, a simulated flight pattern or other specific information.

Such a transparent membrane touch panel is shown in U.S. Pat. No. 4,085,302. Inventors Zenk, Johnson and Miller, two of whom are applicants herein, describe a spherically-contoured touch panel particularly well suited for use with a CRT screen. A glass substrate is provided with conductive strips of indium oxide, and the flexible polyester membrane is coated with conductive strips of gold. The membrane has a slightly shorter radius of curvature than does the substrate, and is thus self-supporting to maintain separation between the membrane strips and substrate strips so that all circuits are normally open. There are problems with this design—for example, the difficulty in molding the polyester membrane and its strips to the desired spherical contour and the obvious incompatibility with flat surfaces—which make a planar touch panel desirable. However, a flat polyester membrane is self-supporting only for panels of limited size, i.e., about four inches (10 cm.) square.

To provide support between the substrate and membrane, the above patent describes an electrically insulative grid approximately 0.0001 inch (0.0025 mm.) thick. This grid is elastically deformable to allow chosen opposing strips to touch one another responsive to finger pressure. This grid is expensive, shows wear after repeated cycles or deformation incidents, and reduces the transparency of the touch panel.

An alternative to the grid is a separator sheet shown in U.S. Pat. No. 3,617,666 to Brane granted Nov. 2, 1971. Two fabric layers 3 and 5 are held apart from one another by a separator sheet 4. Openings 12 are provided in the separator sheet. Sheet 4 is then positioned in the touch panel to align openings with the various strip intersections. Such a separator sheet detracts from the aesthetic appearance of the touch panel and reduces transparency. Further, the sharp edges at the openings create stress concentrations which, over repeated cycles, can damage both the separator sheet and the flexible membrane. Specifically, continued flexing of a membrane conductive strip across its associated edge eventually wears down the strip to increase its resistance or even permanently open the circuit. Continued flexing also gradually rounds the edges of the separator sheet. The debris from this process produces an insulating dust within the switch array causing a phenomenon known as "hard touch."

It is an object of this invention, therefore, to provide a simple, low-cost means for normally separating a touch panel flexible membrane from its opposed substrate. Another object is to provide such separation with minimal reduction in transparency of the touch panel, and to significantly increase the useful life of the panel in terms of its resistance to wear from repeated circuit connections.

SUMMARY OF THE INVENTION

To accomplish these and other objects, there is shown a touch panel in the form of a planar electrical switch. The switch includes a flat, flexible and electrically insulative membrane and a flat and electrically insulative substrate layer. Integral with the membrane are a plurality of first electrically conductive paths, separated from one another by insulative boundaries. A plurality of second electrically conductive paths are integral with the substrate layer. The second conductive paths are separated from one another by insulative boundaries. The switch further includes a mounting means for supporting the membrane and substrate layer proximate one another with the first and second conductive paths facing each other and normally spaced apart from each other. The mounting means aligns the membrane and substrate layer. Because of the alignment, elastic deformation of the membrane, at a selected location on the membrane and toward the substrate layer, moves a selected one of the first paths into electrical contact with a selected second path. Dielectric spacing means are positioned between the membrane and the substrate layer. These spacing means confine and guide the deformation of the membrane in the area of the selected location. The spacing means have a generally convex surface facing the membrane.

Preferably, the surface of the spacing means facing the membrane is cylindrical. In fact, the preferred spacing means are a plurality of filament spacers, each of circular cross section.

An advantageous location for the spacing means is against the boundaries separating the second paths from one another. So located, the spacing means separate the membrane and substrate while causing minimal interference with membrane flexure necessary to close the switch. One typical arrangement is that the first paths and their associated boundaries on the membrane are straight and parallel to one another while the second paths and their associated boundaries, similarly straight and parallel, are orthogonal to the first paths. In this arrangement, the spacing means is preferably a plurality of filament spacers, each positioned against one of the boundaries associated with the second paths.

Yet another feature of the present invention is flexibility in the filament spacers. When the membrane and substrate layer are mounted within a peripheral frame, each spacer can span the distance across the membrane and substrate layer, fastened at each of its ends to the frame. Each filament spacer is then free to move laterally over substantially its entire length, enabling it to yield to membrane pressure at a particular location, thus to reduce wear. A further refinement is to use elastic filament spacers, mounting them in slight tension. The flexible spacers retain the ability to yield as described and also are self-correcting in that, responsive to the tensile force, they seek the desired linear span across the panel.

Finally, where a transparent panel is required, a substantially transparent material such as polyester is selected for the membrane and the substrate layer. Correspondingly, the filament spacers can be constructed of a nylon fiber chosen for a transparency and index of refraction similar to that of the polyester film, successfully camouflaging them.

A touch panel in accordance with the present invention is relatively inexpensive, yet effectively overcomes the problems of open circuits or increased resistance from wear to the conductive paths on the flexible membrane. Further, wear to the spacing means is reduced, avoiding the problem of hard touch. Also, in the typical touch panel where the conductive paths are substantially wider than the boundaries between them, the filament spacers, being confined to the boundary area, provide minimal interference with desired membrane flexure and panel transparency.

IN THE DRAWINGS

Other features and advantages of this invention will become apparent upon reading the following detailed description and upon reference to the drawings in which.

DETAILED DESCRIPTION OF THE PREFERRED EMBODIMENT

Figure 1:
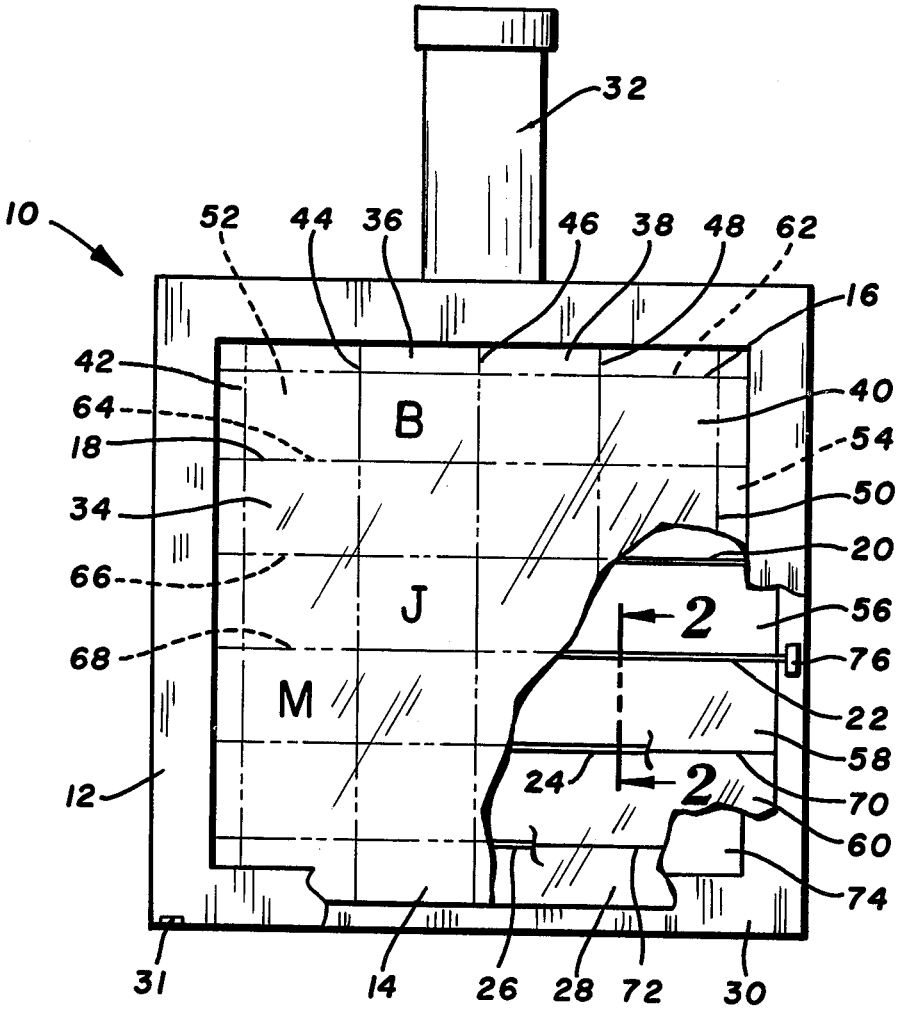
FIG. 1 is a plan view of a flat touch panel constructed in accordance with this invention.

Referring to the drawings, there is shown in FIG. 1 an electrical switch comprising a touch panel 10. Portions of the several components of the touch panel are cut away to reveal its layered construction. These components include an upper frame 12, an upper layer or membrane 14, a spacing layer composed of filament spacers 16 through 26, a lower layer or substrate 28 and a lower frame 30. The intermediate layers are bonded together between the upper and lower frames. A filtered vent 31 permits air movement into and out of panel 10. Finally, to permit electrical communication with the environment beyond the touch panel, a flexible cable 32, including the requisite electrical lines, is attached to the frame. While further description of individual layers follows, reference is also made to U.S. Pat. No. 4,085,302 for a more detailed description of the above components.

Membrane 14 is preferably flat, and constructed of a dielectric (electrically insulative) and elastically deformable material. For certain uses, the membrane material should be transparent as well. One satisfactory material meeting all these requirements is a polyester film sold by DuPont Corporation under the trademark Mylar. A substantially uniform membrane thickness of 0.007 inches (0.18 mm) has been found satisfactory. The conductive paths including vertical strips 34 through 40 are formed by first coating membrane 14 with a fine layer of gold, 200 to 300 angstroms thick. Vertical strips 34 through 40, and their accompanying boundaries, 42 through 50, are then printed on the membrane. Developing and etching processes complete the formation of the desired conductive paths.

Substrate 28 also can be constructed of polyester film, with horizontal strips 52 through 60 and accompanying boundaries 62 through 72 formed of gold pursuant to the above process. Alternatively, as the substrate layer need not be flexible, it can be constructed of glass, with indium oxide used to form the electrically conductive horizontal strips. In uses requiring panel transparency, the indium oxide offers slightly improved transparency as compared to the gold. However, the polyester and Mylar combination is significantly less costly, and gold, with its high electrical conductivity compared to indium oxide, permits the use of narrower paths to transmit the same electrical current. Of course, when both membrane 14 and substrate layer 28 are elastically deformable, touch panel 10 is preferably mounted against a backing 74 as indicated.

Figure 2:
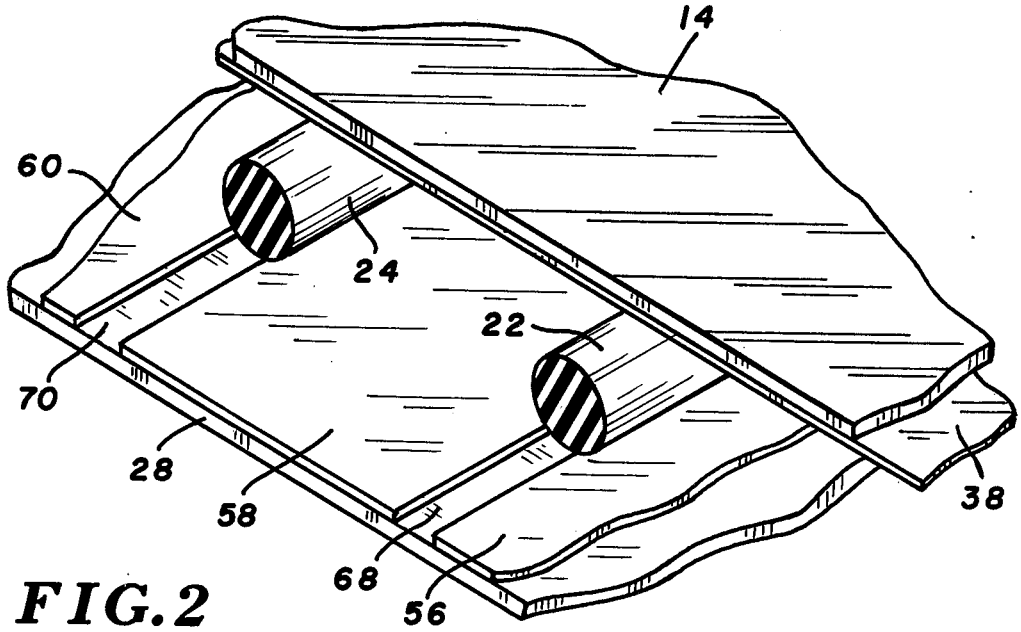
FIG. 2 is a partial perspective view taken along the line 2—2 in FIG. 1 showing two of the filament spacers between the touch panel membrane and substrate.
Figure 4:
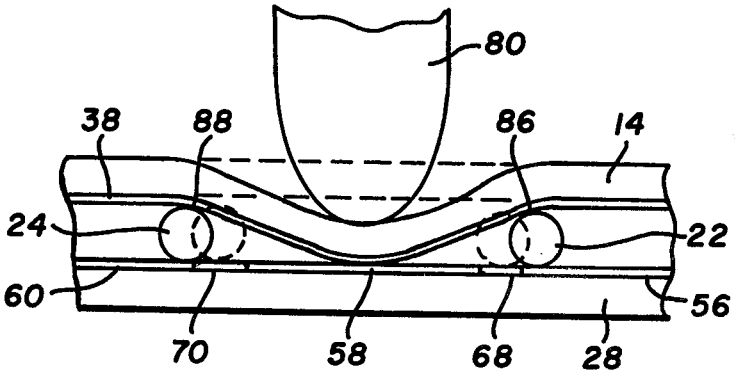
FIG. 4 is a cross section similar to FIG. 3, but taken along the line 2—2 in FIG. 1.

Membrane 14 and substrate layer 28 are mounted in the touch panel in spaced-apart relation, and, as seen from FIGS. 2 and 4, with the conductive paths of each facing the other. The orientation of the vertical strips is preferably perpendicular to the horizontal strips. This enables selective closing of switch 10 by finger or instrument pressure to membrane 14 over a chosen intersection of a horizontal strip and vertical strip. For example, B in FIG. 1 corresponds to the intersection between vertical strip 36 and horizontal strip 52. Likewise, the letters J and M indicate, respectively, the intersection of strips 36 and 56, and the intersection of strips 34 and 58. Normally, switch 10 is open, with none of the vertical strips and horizontal strips touching one another. Vent 31 permits rapid membrane response to application and removal of pressure.

Membrane 14, when sufficiently small, is self-supporting and can maintain the switch open without intermediate support between it and substrate 28. However, as touch panel size exceeds four inches square, membrane thickness must be increased to retain the self-supporting ability, and increased thickness involves increased problems with parallax. Further, even if the membrane is sufficiently strong to be self-supporting, attempts to close the switch at a chosen intersection of strips can cause widespread uncontrolled elastic deformation in the polyester film. When not sufficiently localized, such deformation can cause unwanted electrical contact between vertical and horizontal strips near the selected pair.

To eliminate such unwanted contact, there is provided a spacing means between membrane 14 and substrate layer 28, shown as the six filament spacers 16 through 26. The filament spacers are oriented horizontally as viewed in FIG. 1, for example parallel with horizontal strips 52 through 60. Each filament spacer spans the width of touch panel 10 and is positioned against one of horizontal boundaries 62–72. A filament spacer can be attached to its associated boundary. However, in the preferred embodiment, each spacer is secured at each of its ends to lower frame 30 by fasteners such as the one shown at 76. These fasteners can be clamps, staples or epoxy adhesive. Other fastening means will occur to those skilled in the art. The purpose of fasteners 76 is to maintain the filament spacers in their horizontal orientation. Further, the filament spacers are preferably elastically deformable and held by the fasteners in slight elastic tension.

FIG. 2 shows, in enlarged perspective, portions of filament spacers 22 and 24 between membrane 14 and substrate 28, more specifically, between vertical strip 38 and horizontal strips 56, 58 and 60. Filament spacers 22 and 24 are of cylindrical construction. Preferred spacer diameters range from 0.002 to 0.020 inches (0.05 to 0.5 mm) depending upon the desired touch level or force for a particular application. As the filament spacers may simultaneously contact the conductive paths of both substrate layer 28 and membrane 14, they should be constructed of a dielectric material. Further, when used with a transparent touch panel, the filament spacers should not visibly stand out from the polyester film of the substrate and membrane. Nylon has been found to be a satisfactory material for spacers 16 through 26, as it has the requisite elasticity, is dielectric, and further, can be selected to have a transparency and index of refraction sufficiently near that of the polyester film so as to be nearly invisible in a transparent touch panel.

Figure 3:
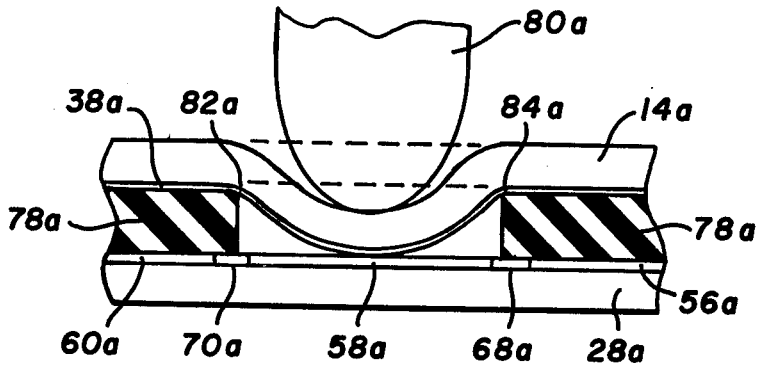
FIG. 3 PRIOR ART
FIG. 3 is a cross sectional view of a portion of a prior art touch panel.

FIGS. 3 and 4 can be compared in order to better understand the advantages afforded by a spacer means in accordance with the present invention. FIG. 3 shows a prior art touch panel in which a spacer layer 78*a* separating a flexible membrane 14*a* and a substrate 28*a*. A thin layer of gold forms a conductive strip 38*a* on membrane 14*a*. Substrate layer 28*a* in turn has a conductive layer attached thereto and opposing gold layer 58*a*. A finger or instrument 80*a* is shown applying pressure to membrane 14*a*, deforming the membrane sufficiently to establish electrical contact between the opposed conductive surfaces. In the absence of pressure from finger 80*a*, membrane 14*a* and its conductive gold layer return to the normal, unstressed configuration shown by the broken lines.

Indicated at 82*a* and 84*a* are areas of high stress concentration caused by the sharp edges of spacer layer 78*a*. Appearing as points in the figure, these area actually are linear along the entire spacer layer edge proximate the locus of membrane depression. The expected life of a touch panel can involve thousands or even millions of membrane deformations, and any damage to the panel caused by such deformation necessarily shortens its useful life. The prior art panel of FIG. 3 is susceptible primarily to two forms of damage from repeated deformations or cycles. First, strip 38*a* is subject to wear along the stress concentration areas. Each cycle results in some wear to the conductive layer, and taken alone is not significant. Yet the effect of numerous cycles is to reduce the conductivity of gold strip 38*a*, and eventually to permanently open the circuit. Another problem arises due to the corresponding wear that occurs to the spacer layer at its sharp edges. As these edges are gradually rounded, spacer debris or dust is formed and contained in the enclosed area between the membrane, substrate and spacer. This insulative dust eventually interferes with the flow of current between conductive strips 38*a* and 58*a*, causing a phenomenon known as "hard touch." In other words, the circuit can be completed, but only with substantially greater pressure.

In FIG. 4, filament spacers 22 and 24 are shown between membrane 14 and substrate 28. Vertical strip 38 is shown as a layer of gold attached to the membrane. The conductive layer opposed to vertical strip 38 is horizontal strip 58. Also shown as mounted on substrate layer 28 are horizontal strips 56 and 60 on either side of horizontal strip 58. Pressure from finger (or instrument) 80 deforms membrane 14 a sufficient amount to establish electrical contact between vertical strip 38 and horizontal strip 58. Filament spacers guide membrane deflection, confining it to the area proximate the intended contact. As indicated by the broken line, when finger or instrument pressure is removed, membrane 14 returns to its normal, unstressed planar configuration.

The circular cross section of filament spacers 22 and 24 significantly reduces wear to vertical strip 38 and to these filament spacers, thereby extending the useful life of the touch panel. The entire surface of each filament spacer is cylindrical. However, of primary importance is the generally convex upper surface, that is, the surface facing membrane 14. Unlike the sharp edges of prior art spacers, the cylindrical contact areas of filament spacers 22 and 24, indicated respectively at 86 and 88, create virtually no stress concentrations, and, consequently, virtually no wear to vertical strip 38 or to either filament spacer. This, of course, simultaneously addresses the problems of open circuits, increased resistance, and hard touch. In fact, tests show that after one million cycles, there is negligible wear and no measureable change in resistance of the particular vertical strip involved. Also, there is no filament wear and accordingly no increase in switch contact pressure necessary to establish electrical contact.

As indicated from the broken line, spacers 22 and 24, because they are anchored only at their ends, are free to float. As a result they move slightly outward from their normal locations as pressure is applied, then return to their locations over horizontal boundaries 68 and 70 when finger pressure is removed. This freedom to float increases the tendency in filament spacers 22 and 24 to relieve stress, and distributes any strip wear over a greater surface area than would otherwise be the case. Preferably the filament spacers are held in slight tension. Spacer floating is then more controlled, and spacers more rapidly return to their normal locations once switch 10 is opened.

The filament spacers described thus substantially extend the life of a touch panel electrical switch. The filament cylindrical contour, particularly that opposed to the flexible membrane, reduces wear both to the membrane and to the spacers themselves. When the spacers extend across the width of a touch panel and are fastened only at their ends, they are free to float near the area of membrane flexure, and thus further extend panel useful life. In addition, use of the filament spacers reduces manufacturing cost as compared to prior art spacer layers. Maximum transparency can be achieved, first since the spacers occupy a minimal portion of the entire panel surface area, and further since the filament spacers themselves can have a transparency near that of the membrane material.

What is claimed is:

1. A planar electrical switch, including:

a flat, flexible and electrically insulative membrane;

a flat and electrically insulative substrate layer;

a plurality of substantially straight and parallel first electrically conductive paths integral with said membrane and separated from one another by first insulative boundaries parallel with said first paths;

a plurality of substantially straight and parallel second conductive paths integral with said substrate layer and separated from one another by second insulative boundaries parallel with said second paths;

mounting means at the periphery of said substrate layer for supporting said membrane and substrate layer proximate one another with said first and second conductive paths facing each other and normally spaced apart from each other, and further for aligning said membrane and said substrate layer whereby elastic deformation of said membrane at a selected location thereon and toward the substrate layer moves a selected one of said first paths into electrical contact with a selected second path; and dielectric spacing means spanning the distance across said substrate layer, positioned between said membrane and substrate layer, and fastened at each end thereof with respect to the substrate periphery for confining and guiding the deformation of said membrane proximate said selected location, said spacing means having a generally convex surface facing the membrane.

2. The electrical switch of claim 1, wherein the surface of said spacing means facing the membrane is cylindrical.

3. The electrical switch of claim 2, wherein:

said spacing means normally is positioned against said second boundaries.

4. The electrical switch of claim 1, wherein: said spacing means comprises a plurality of filament spacers, each of circular cross-section.

5. The electrical switch of claim 4, wherein:

said second paths and their associated boundaries are orthogonal to said first paths; and wherein each of said filament spacers is normally positioned against one of the second boundaries.

6. The electrical switch of claim 5, wherein:

said mounting means comprises a frame assembly coincident with the periphery of said substrate layer, and each filament spacer spans the distance across said substrate layer and is fastened at each end thereof to said frame assembly.

7. The electrical switch of claim 6, wherein: each filament spacer is of elastic material and held in tension.

8. The electrical switch of claim 7, wherein: said membrane, substrate layer, paths, boundaries and filament spacers are substantially transparent.

9. The electrical switch of claim 8, wherein: said membrane substrate layer and filament spacers have substantially similar transparencies and indices of refraction.

10. The electrical switch of claim 5, wherein:

each of said filament spacers is substantially rigid in directions orthogonal to the length of said second boundaries.

* * * * *